US005233362A

United States Patent [19]

Villaseca et al.

[11] Patent Number: 5,233,362

[45] Date of Patent: Aug. 3, 1993

[54] MAYPOLE ANTENNA

[75] Inventors: Eduardo H. Villaseca, Costa Mesa; Donald G. Keppler, Huntington Beach, both of Calif.

[73] Assignee: Hughes Aircraft Company, Los Angeles, Calif.

[21] Appl. No.: 646,580

[22] Filed: Jan. 28, 1991

[51] Int. Cl.[5] ..... H01Q 1/32; H01Q 1/36; H01Q 1/48

[52] U.S. Cl. ..... 343/712; 343/713; 343/749; 343/847; 343/896; 343/834

[58] Field of Search ..... 343/825, 826, 828, 829, 343/896, 898, 899, 834, 722, 749, 711–714, 846–849

[56] References Cited

U.S. PATENT DOCUMENTS

| | | | |
|---|---|---|---|
| 2,898,590 | 8/1959 | Pichitino | 343/722 |
| 3,001,194 | 9/1961 | Leppert | 343/896 |
| 3,229,297 | 1/1966 | Bell et al. | 343/896 |
| 3,384,896 | 5/1968 | Kriz | 343/713 |
| 4,125,840 | 11/1978 | Cassel | 343/826 |

FOREIGN PATENT DOCUMENTS

| | | | |
|---|---|---|---|
| 43-21616 | 2/1965 | Japan | 343/714 |

*Primary Examiner*—Michael C. Wimer

*Attorney, Agent, or Firm*—Wanda K. Denson-Low

[57] ABSTRACT

An antenna (20) has a set of elongated electrically conductive radiating elements (24) disposed about a central mast (26) in the form of a maypole. The radiating elements are electrically connected to each other at a top end of the mast by a top ring (28) and near a bottom end of the mast by a bottom ring (30), both of the rings being electrically insulated from the mast. A positioning unit (32) is located on the mast between the two rings for bowing the radiating elements away from the mast. Sections of the respective radiating elements located between the positioning unit and the bottom ring are severed and connected together by impedance elements (82). Each of the impedance elements includes a resistor (84) which serves as a load for providing a current distribution in a radiating element similar to that of a traveling wave, the impedance elements also having an inductor (86) and a capacitor (88) connected in parallel with the resistor. The inductor tunes out capacitive reactance of the antenna impedance at a low end and the capacitor shunts out the inductor and the resistor at a high end of an operating frequency band of the antenna. The lower end of the mast may be mounted in a vehicle (22) which serves as an electrically conductive support of the antenna. Signals are fed to the antenna between the bottom ring and ground.

9 Claims, 5 Drawing Sheets

MAYPOLE ANTENNA

BACKGROUND OF THE INVENTION

This invention relates to a monopole electromagnetic antenna having one or more radiating elements in the form of elongated conductors extending from a support, such as a plurality of wires secured about a mast, and being operative in a frequency band including frequencies wherein the antenna is electrically short, less than one-quarter wavelength.

Such an antenna is advantageous because of mechanical simplicity which facilitates installation, removal, and transportation of the antenna. For example, the antenna is readily transported by a truck, may be mounted to the truck, and is readily positioned to provide an azimuthal radiating pattern. The antenna may be deployed as part of a communication link.

A problem arises, particularly at the lower frequencies of the band wherein the antenna is electrically short. For example, in the case wherein the radiating elements comprise a set of wires, the radiating elements exhibit resonant behavior and capacitive reactance which narrow the bandwidth, introduce losses in a matching network between a transmitter and the antenna, and produce an antenna input impedance which varies rapidly with frequency. Also, there is relatively low radiation resistive loading resulting in a low power gain. Therefore, the use of such an antenna has been restricted to situations in which the output stage or matching network of a transmitter connected to the antenna is tuned to operate over a relatively narrow bandwidth. Where it has been necessary to employ the antenna in a wider band situation, such as a situation involving a scanning of the signal frequency, it has been necessary to rematch the antenna at each frequency of operation. This limits the rapidity of frequency shifting. The foregoing comments relating to the use of a transmitter with the antenna apply also to the use of a receiver with the antenna because the antenna operates in reciprocal fashion and produces the same antenna characteristics both for transmission and reception.

SUMMARY OF THE INVENTION

The aforementioned problem is overcome and other advantages are provided by an antenna comprising a plurality of elongated radiating elements arranged about a central longitudinal axis of the antenna and wherein, in accordance with the invention, each of the radiating elements is divided into two separate sections which are joined by a lumped impedance element. In a preferred embodiment of the invention, the radiating elements are formed as a set of wires uniformly distributed about a central support which is electrically isolated from the radiating elements. It is convenient to form the support as a mast which is mounted vertically to a truck which is employed for transporting the antenna. Top and bottom electrically-conductive rings secure top and bottom ends of the wires near the top and the bottom end of the mast. A central positioning unit having radially extending struts is located on the mast between the top and the bottom rings for bowing the wires outwardly and for positioning the wires symmetrically about the mast.

To provide an azimuthal radiation pattern, the mast is held vertically and serves to position the individual radiating elements at a predetermined distance from the ground. The bottom ring and the ground serve as terminals of a feed for the antenna by which a transmitter or receiver is connected to the antenna. Alternatively, the bottom ring and a metallic roof of the truck serve as terminals of a feed for the antenna by which a transmitter or receiver is connected to the antenna. In a preferred embodiment of the antenna, the wire of each radiating element is cut in two sections, the cut being located between the bottom ring and the positioning unit. A load comprising at least a resistor, and preferably also an inductor and a capacitor connected in parallel to the resistor, is located in the cut of each radiating element, and is serially connected between the two sections of the radiating element.

In accordance with the invention, the load in each radiating element introduces a desired set of electrical characteristics to the antenna. The set of loads in the radiating element retains the azimuthal radiation pattern, and increases the operating bandwidth of the antenna. The resistors in the respective loads suppress resonant behavior. Electric current distribution in each of the radiating elements closely resembles that of a traveling wave. The set of inductors of the respective loads is selected to decrease capacitive reactance of the antenna feed at the low frequency end of the operating band. The capacitors of the respective loads are selected to cancel inductive reactance of each load, and provide a low impedance path to input signals applied to the antenna at the high frequency end of the operating band.

BRIEF DESCRIPTION OF THE DRAWING

The aforementioned aspects and other features of the invention are explained in the following description, taken in connection with the accompanying drawing wherein.

DETAILED DESCRIPTION

Figure 2:
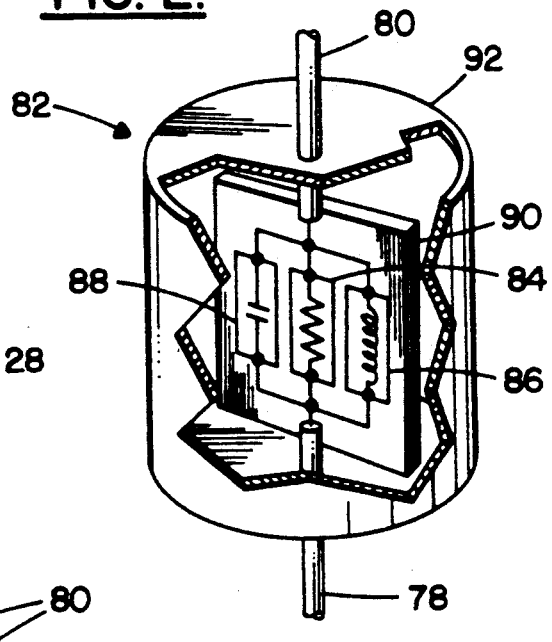
FIG. 2 is an enlarged detailed view of an impedance element employed in each radiating element of the antenna, an outer case of the impedance element being partially cutaway to disclose electrical components of the impedance element.
Figure 1:
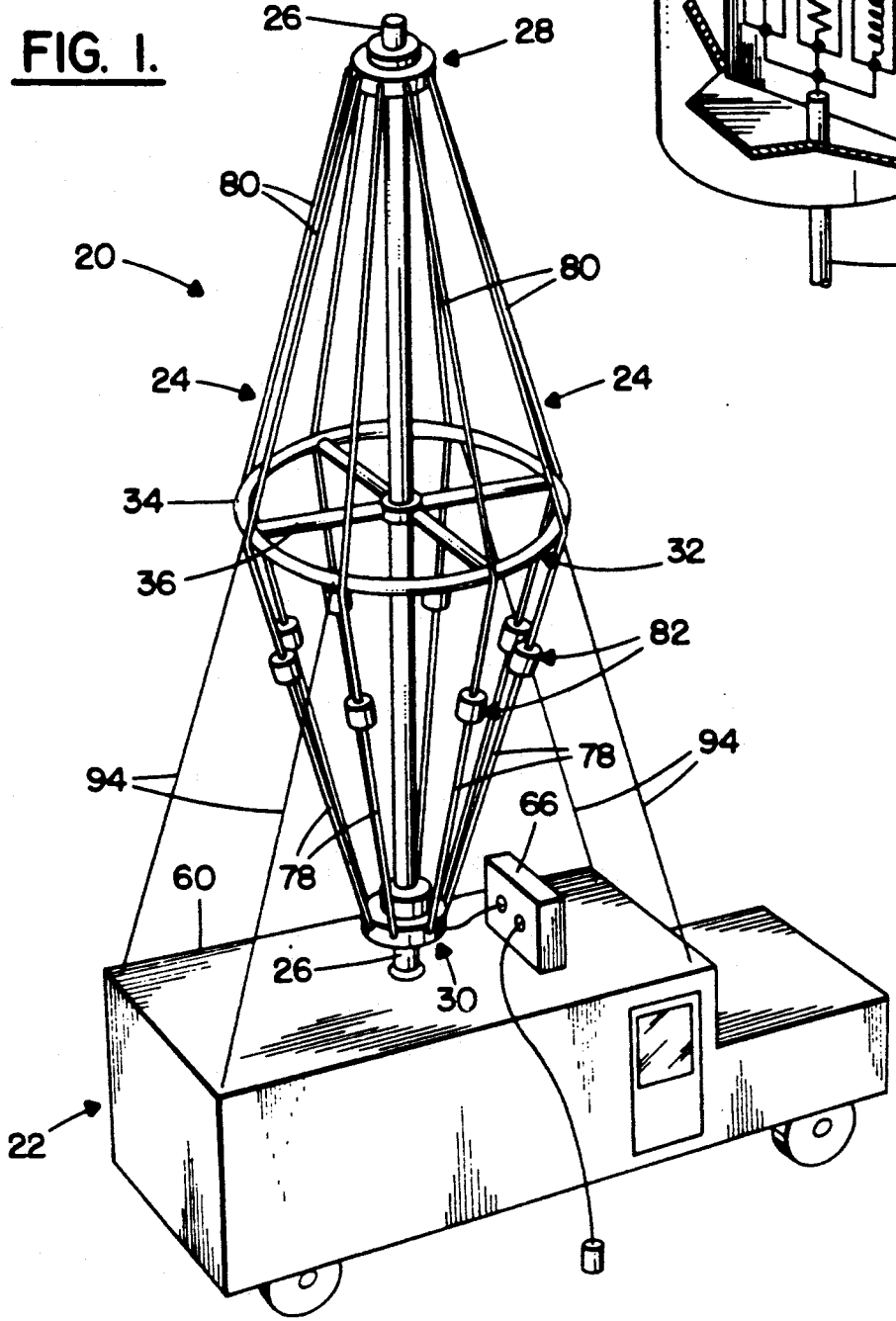
FIG. 1 is a stylized perspective view of the antenna of the invention mounted on a truck.

With reference to FIGS. 1-6, an antenna 20 of the invention is mounted upon a suitable supporting structure such as a truck 22 which holds the antenna 20 in a vertical position for radiating electromagnetic waves in an azimuthal radiation pattern. The antenna 20 comprises a plurality of elongated radiating elements 24 which are arranged, preferably, symmetrically about a central supporting mast 26 to produce axial symmetry to the radiation pattern about the mast 26. The antenna 20 is readily assembled and disassembled to facilitate transportation of the antenna within the truck 22 to a suitable site for the transmission and the reception of electromagnetic signals. By way of example, the antenna 20 may be employed for the transmission and reception of signals in a communication link. To facilitate the ensuing description, the antenna will be described in terms of the transmission of electromagnetic signals, it being understood that the antenna is reciprocal in its operation so that the description applies equally well to the reception of electromagnetic signals.

In a preferred embodiment of the invention, each of the radiating elements 24 is constructed as a length of wire, there being a connector 28 mounted at the top or distal end of the mast 26 for supporting the top or distal ends of the radiating elements 24, and a connector 30 located near the bottom or proximal end of the mast 26 for supporting the bottom or proximal ends of the radiating elements 24. To facilitate the description of the antenna 20, the connector 28 may be referred to as the top connector, and the connector 30 may be referred to as the bottom connector. It is to be understood that the antenna 20 may be mounted in positions other than the vertical position presented in FIG. 1, and that the bottom of the mast 26 may be secured to some other form of support (not shown) rather than the truck 22.

A central positioning unit 32 is mounted to the mast 26 equally distant from the connectors 28 and 30. The positioning unit 32 is formed in the shape of a wheel and includes a rim 34 joined by struts or spokes 36 to a hub 38 of the positioning unit 32. The hub 38 is held in a selected position on the mast 26 by screws 40 which are manually tightened against the mast 26 during assembly of the antenna 20. The outer periphery of the rim 34 engages with the radiating elements 24 to urge the central portions of the radiating elements 24 outward, away from the mast 26, so as to allow for the use of a longer radiating element within the fixed confines of the predetermined length of the mast 26, and also to separate the radiating elements 24 for improved electromagnetic isolation and reduction of mutual coupling between the radiating elements 24.

During assembly of the antenna 20, the spokes 36 are inserted into sockets 42 of the hub 38, and outer ends of the spokes 36 are secured by fittings 44 to the rim 34. The fittings 44 include loops 46 through which the wires of the radiating elements 44 are to be passed during assembly of the antenna 20. The loops 46 aid in securely locating the radiating elements 24 in their desired positions. The connectors 28 and 30 are constructed identically in the preferred embodiment of the invention so as to facilitate construction of the antenna 20. Each of the connectors 28 and 30 includes screws 48 which are manually tightened against the mast 26 during assembly of the antenna 20 to hold securely the connectors 28 and 30 in their desired positions on the mast 26. To facilitate description of the connectors 28 and 30, further details in their construction will be made with reference to the connector 28, it being understood that the description applies equally well to the connector 30.

The connector 28 is provided with a circumferential ring 50 of electrically conductive material which encircles a cylindrical base 52 of electrically insulating material. By way of example, the ring 50 may be fabricated as a copper band, and the base 52 may be formed of plastic, ceramic or fiberglass. A plurality of threaded sockets 54 are disposed serially along the ring 50 for receiving screws 56. Ends of the wires of the radiating elements 24 are looped around the screws 56 which are then tightened in their respective sockets 54 during assembly of the antenna 20. The ring 50 provides for electrical interconnection between the top ends of the radiating elements 24, in the case of the top connector 28, and among the bottom ends of the radiating elements 24, in the case of the bottom connector 30.

In the construction of the mast 26, the mast 26 may be divided into plural sections of pipe (not shown) which are threaded together to form the complete mast 26 upon assembly of the antenna 20. The mast is secured in the operating position of the antenna 20 by passing the bottom portion of the mast 26 through an aperture 58 in a roof 60 of the truck 22. The bottom of the mast 26 is secured by means of a base 62 to the floor 64 of the truck 22 so that the mast 26 stands upon the base 22 in the operating position of the antenna 20. The mast 26 may be fabricated of electrically conductive material, such as a metal pipe or post, or may be fabricated of electrically nonconductive material such as plastic.

In the event that the mast 26 is fabricated of electrically conductive material, the aperture 58 has an oversized diameter which is sufficiently larger than a diameter of the mast 26 so as to provide clearance between the roof 60 and the mast 26 to electrically insulate the mast 26 from the roof 60 of the truck 22. Similarly, the base 62 may be made of electrically insulating material. Also, the spokes 36 and the rim 34 of the positioning unit 32 are constructed of electrically insulating material, such as fiberglass, to maintain electrical isolation among the center portions of the radiating elements 24.

Figure 3:
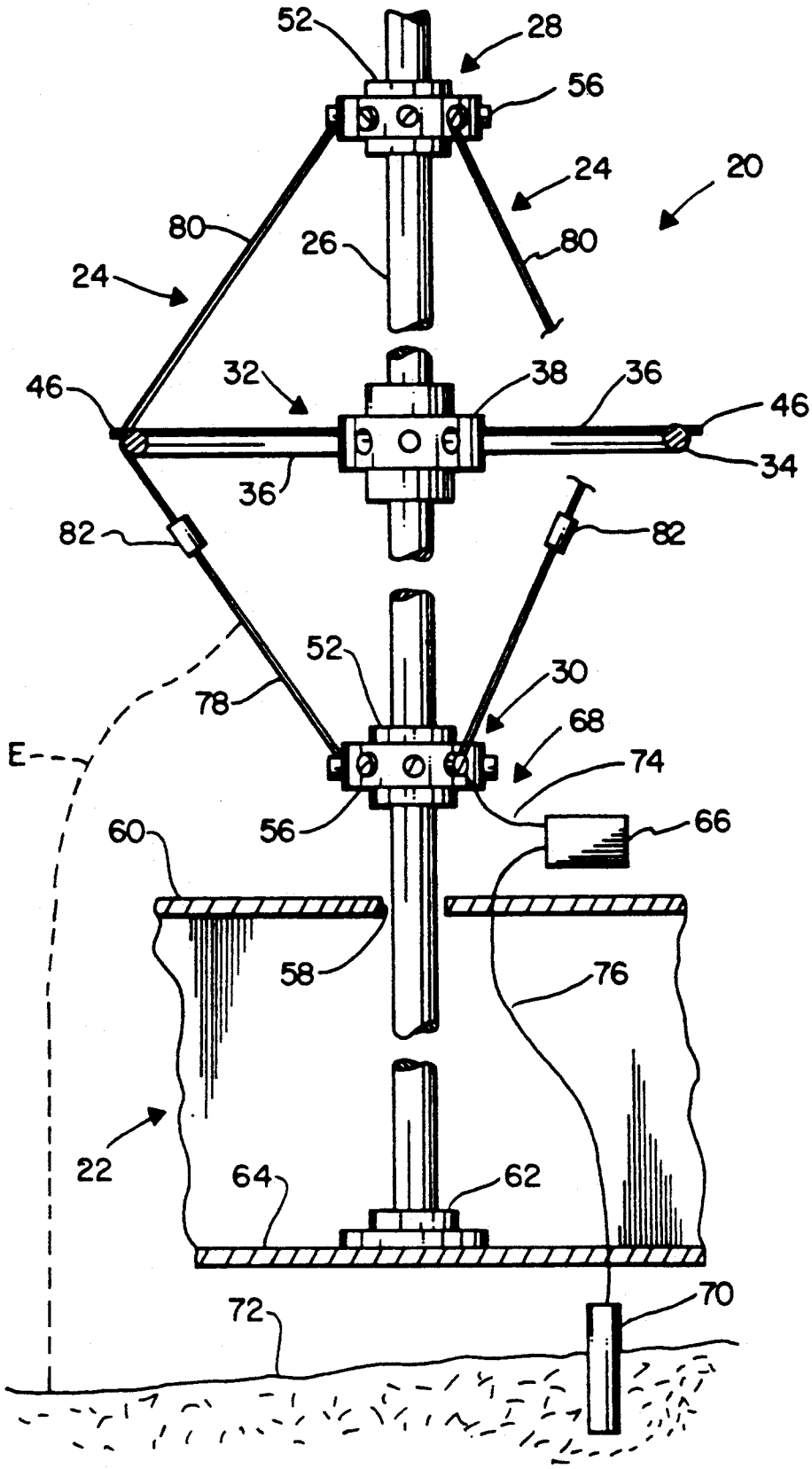
FIG. 3 is a side elevation view, partially sectioned and partially diagrammatic, showing the mounting of the antenna to the truck.
Figure 4:
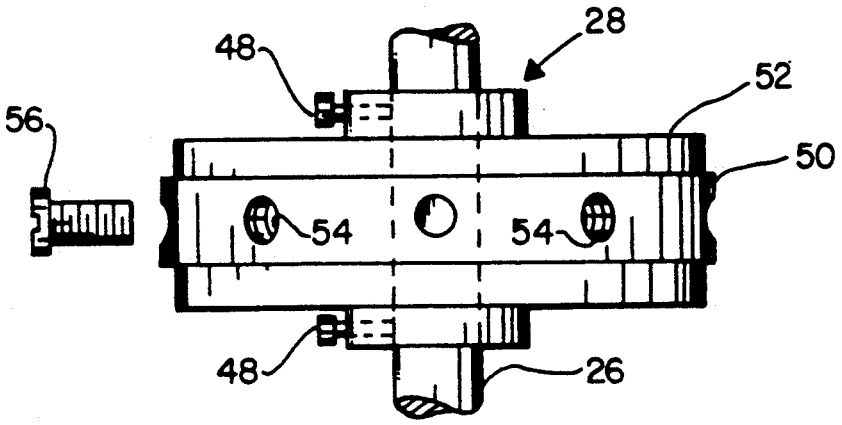
FIG. 4 is a side elevation view of a ring connector employed at the top and the bottom of a set of elongated radiating elements for electrically connecting ends of the radiating elements of the antenna.
Figure 5:
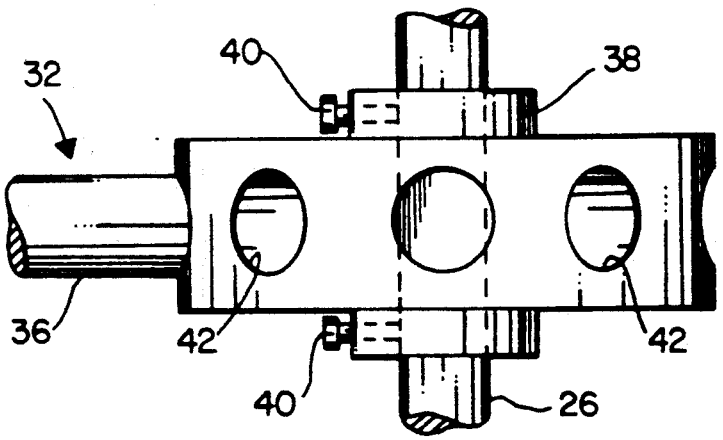
FIG. 5 is a side elevation view, of a hub portion of a wheel-shaped central positioning unit for positioning radiating elements of the antenna, the view of FIG. 5 including one of a plurality of spokes of the wheel-shaped positioning unit.
Figure 6:
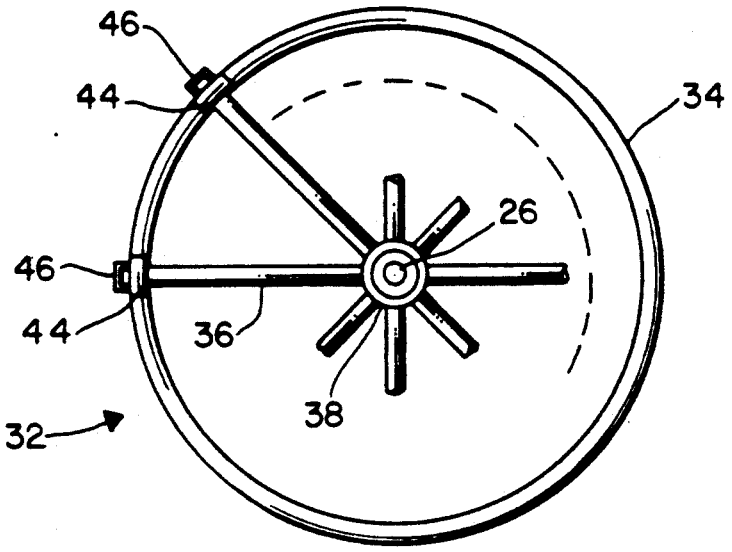
FIG. 6 is a plan view of the wheel-shaped positioning unit, the view showing two of a plurality of the spokes, the remaining spokes being cut away to simplify the drawing.

In accordance with a feature of the invention, FIG. 3 shows a transceiver 66 connected to an input feed 68 of the antenna 20. The feed 68 comprises two terminals, one of the terminals being the ring 50 of the bottom connector 30, and the other terminal being an electrically conductive post 70 embedded in the ground 72. It is assumed that the truck 22 is fabricated of a metal such as steel, and that in view of the electrical isolation between the truck 22 and the antenna 20, the truck 22 may be regarded as a parasitic element of the antenna 20. Connection of the transceiver 66 to the terminals of the feed 68 is made by an electrically insulated wire 74 to the bottom connector 30, and by an electrically insulated wire 76 to the post 70.

Figure 7:
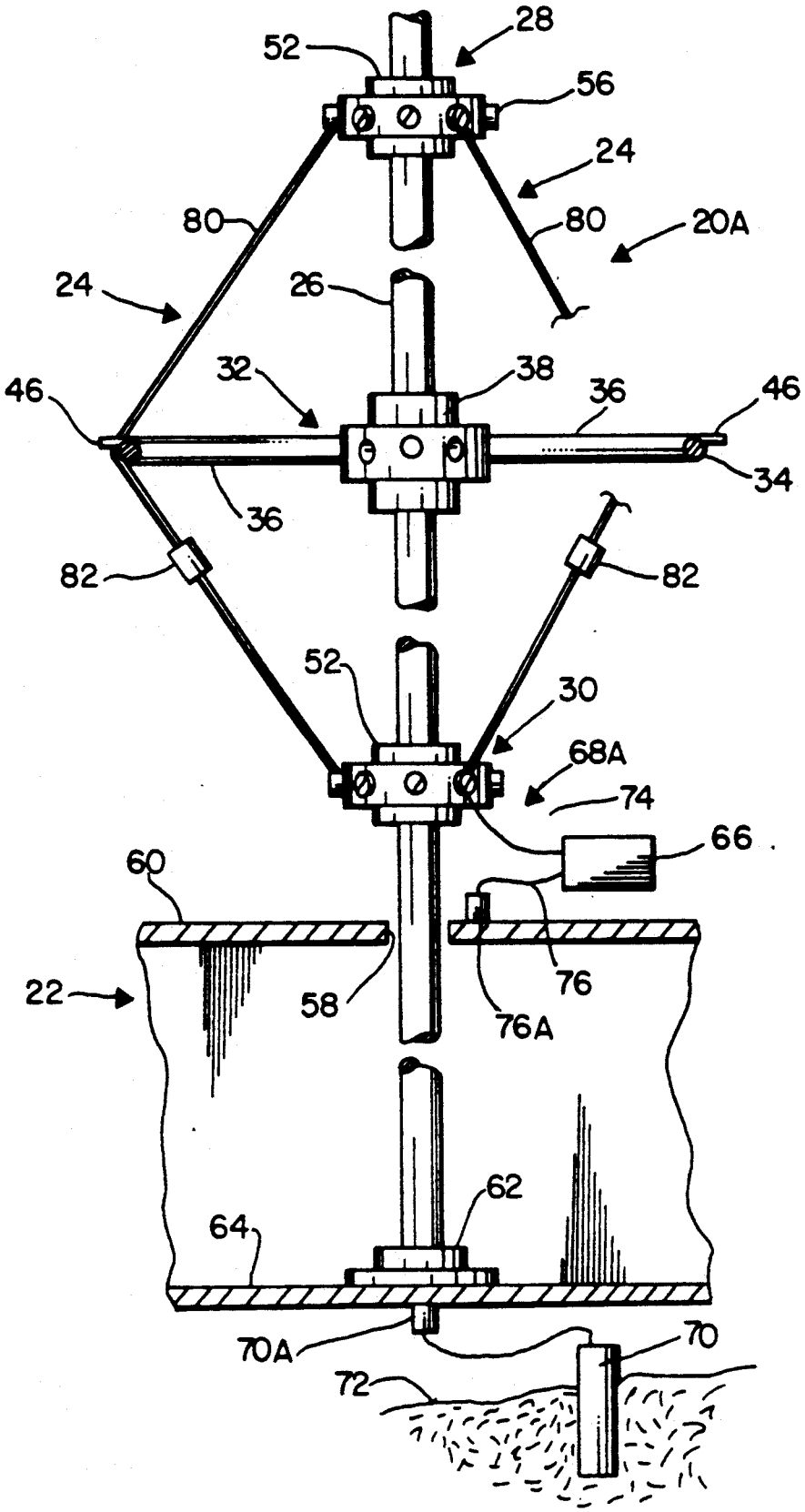
FIG. 7 shows the side elevation view of FIG. 3 with a modified connection of external circuitry to a feed of the antenna.

Alternatively, as shown in FIG. 7, the antenna 20 may be connected via a feed 68A to the transceiver 66. The feed 68A comprises two terminals, one of the terminals being the ring 50 of the bottom connector 30, and the other terminal being a terminal 76A on the truck roof 60 adjacent to the aperture 58. In the case of the interconnection by the means of the feed 68A, the wire 74 of the transceiver 66 is connected to the ring 50 of the bottom connector 30, and the wire 76 is reconnected between the transceiver 66 and the terminal 76A on the truck roof 60. The grounding post 70 is connected to a terminal 70A on the truck floor 64. By virtue of the connection provided by the feed 68A, the truck 22 becomes electrically connected to the antenna 20 so that currents flowing in the radiating elements 24 flow also in the body of the truck 22, as will be described subsequently with reference to FIG. 8.

In accordance with a major feature of the invention, and with reference particularly to FIG. 2, each of the radiating elements 24 is divided into two sections, namely a bottom section 78 and a top section 80 which are joined together by an impedance element 82. The impedance element 82 includes a resistor 84 which provides for a resistive loading of a radiating element. While the impedance element 82 may be located anywhere within a radiating element 24, it has proven most advantageous to locate the impedance element 82 closer to the bottom connector 30 than to the top connector 28. Thus, the bottom section 78 is shorter than the top section 80 in each of the radiating elements 24. Furthermore, the location of the impedance element 82 is, preferably, the same in each of the radiating elements 24, so as to provide for the same electromagnetic characteristics to each of the radiating elements 24.

The resistive loading of the resistor 84 provides a current distribution in each of the radiating elements 24 which resembles that of a traveling wave, thereby to reduce the effects of resonance in the radiating elements 24 and provide for optimal radiation characteristics of the antenna 20.

It is advantageous, furthermore, to include within each impedance element 82 an inductor 86 which is connected in parallel to the resistor 84. The inductor interacts with capacitance of a radiating element 24 so as to reduce capacitive loading on the transceiver 66 at the low end of the frequency spectrum of electromagnetic transmission from the antenna 20. It is also advantageous to include within the impedance element 82 a capacitor 88 connected in parallel with the inductor 86 and the resistor 84, the capacitor 88 having a relatively small value of capacitance to resonate with the inductance of the inductor 86, and to shunt the resistor 84 at the high frequency end of the operating band of the antenna 20. The use of the resistor 84 extends the range of the operating frequency band of the antenna 20 to lower frequencies wherein the antenna 20 is electrically short, while the capacitor 88 aids in extending the high frequency end of the antenna operating band, so as to provide for increased bandwidth of the antenna 20. An operating bandwidth of 10:1, wherein the top frequency is ten times greater than the lowest frequency, is anticipated for the antenna 20.

As a convenience in the fabrication of each impedance element 82, the electrical components thereof, namely the resistor 84, the inductor 86 and the capacitor 88, may be mounted on a circuit board 90 encapsulated within a housing 92 which may be of plastic or glass, or a fiber glass tube. Such a tubular housing has been employed in an experimental model of the antenna, and has a length of five inches and a diameter of two inches. Also, if desired, turns (not shown) of the inductor 86 may be wound about the board 90 for a more compact configuration of the impedance element 82.

In operation, the antenna 20 operates over a broad frequency band including low frequencies wherein the antenna is electrically short. As a practical matter, a preferred embodiment of the antenna 20 is to operate with electromagnetic radiation having a wavelength greater than 100 meters, for example, a wavelength of 150 meters corresponding to a frequency of approximately 2 MHz (megahertz). For operation at a low frequency of 2 MHz, the length of the antenna 20 as measured from the floor of the truck to the top of the mast is 30.5 meters in a preferred embodiment of the invention. Herein, the physical length of the radiating element 24 is only approximately 20% of the wavelength of the radiation. Guy wires 94 may be connected from the rim 34 of the positioning unit 32 to corners of the truck roof 60 to stabilize the antenna 20 in its vertical position; for example, the guy wires 94 can stabilize the antenna 20 against the forces of a wind. The guy wires 94 are constructed of electromagnetically inactive material such as nylon chords.

In the construction of the antenna 20, eight of the radiating elements 24 are employed in a preferred embodiment of the invention, the eight radiating elements being symmetrically positioned about the mast 26 suggestive of a maypole to provide for a uniform radiation pattern in azimuth. However, if desired, the number of radiating elements 24 can be increased or decreased and, furthermore, the locations of the radiating elements can be offset from their positions of symmetry if it is desired to produce a specially configured, nonsymmetric radiation pattern. Preferably, all of the impedance elements 82 are constructed identically. If desired, the mast can be part of a vertical parasitically excited loop, isolated from the maypole for improved directivity and reduced resonance effects with the supporting structure of the truck. The input impedance of the antenna 20 at the feed 68 or 68A is 50 ohms in a preferred embodiment of the invention.

The design of the antenna 20 allows for a low profile by virtue of the capability of the antenna for operating in an electrically-short portion of the operating frequency band. The use of the resistive component of the impedance element 82 serves as a practical way to increase the resistive component of the input impedance of the antenna 20 in the electrically short region of operation without altering the azimuthal radiation pattern, this enabling the attainment of the input impedance of 50 ohms. The resistive loading reduces the coupling between the eight arms or radiating elements 24, of the antenna by virtue of the near traveling-wave current distribution between the bottom connector 30 and the resistive load in each of the radiating elements. Locating the resistive load near the bottom connector 30 is more effective for increasing the resistive component of the input impedance of the antenna, but this occurs at a cost of decreased antenna efficiency. The inductor 86 is useful in this respect of increasing the input impedance by decreasing the effect of the capacitive reactance of the antenna at the frequencies wherein the antenna is electrically short.

At the high frequency end of the operating band, the capacitor 88, in parallel with both the resistor 84 and the inductor 86, is useful in canceling the inductive reactance of the load of the impedance element 82, and serves also to provide a low impedance at the high frequency end of the operating range wherein the antenna is electrically long. If the resistive load of the impedance element 82 is located nearer to the feed 68 or 68A, the antenna efficiency would be decreased and the power gain at zero degrees elevation would be reduced. Such loss of efficiency is a consequence of the concentration of current at the region of the antenna near the feed in the electrically short situation. However, by locating the impedance element 82 nearer to the positioning unit 32, a satisfactory current distribution is obtained resulting in adequate antenna efficiency. As shown in FIG. 3, a location of the impedance element 82 wherein the top section 80 of a radiating element 24 is approximately double the—length of the bottom section 78 provides a good balance among the various operating parameters of the antenna 20.

A useful feature in the design of the antenna 20 is the fact that the value of the resistor 84 may be selected substantially independently of the value of the inductor 86. The magnitude of the resistor 84 is selected to provide for a desired input impedance to the antenna, and the location is adjusted to provide effectively for a traveling wave current distribution for frequencies wherein the antenna is electrically short. The value of the inductor 86 is selected to cancel the capacitive reactance presented at the antenna feed at frequencies wherein the antenna is electrically short. And, if desired, the capacitor 88 may be employed at the high-frequency end of the operating frequency band of the antenna, wherein the antenna is no longer electrically short, to at least partially by pass the impedance introduced by the inductor 86 and the resistor 84.

Figure 8:
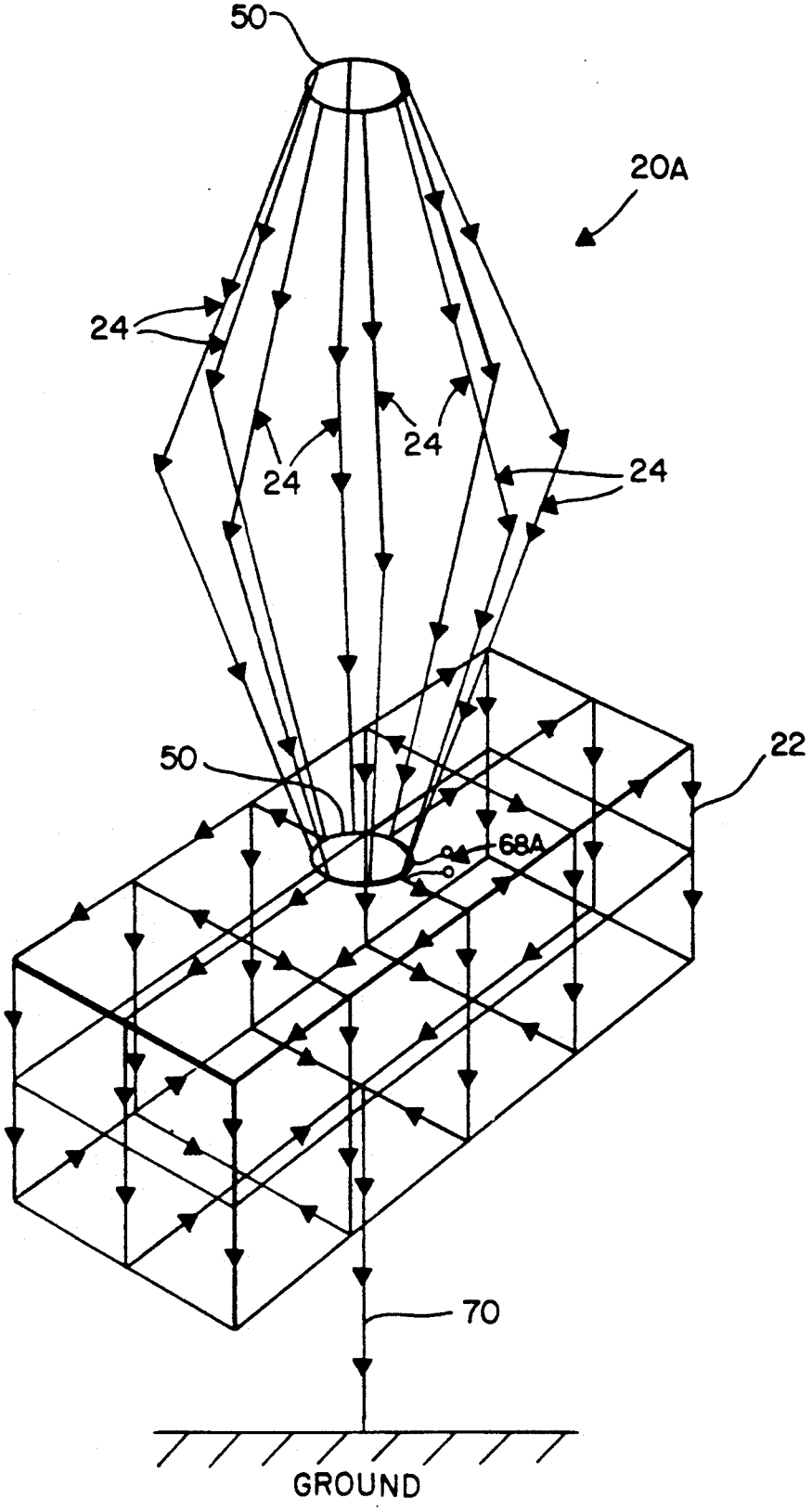
FIG. 8 is a schematic view of the antenna of FIG. 7 showing current flow within the radiating elements and the truck during excitation of the antenna.

Also shown in FIG. 3 is an electric field line, E, of an electromagnetic wave transmitted from the antenna 20. The electric field line extends from a radiating element 24 to the ground 72 in accordance with the usual field distribution of antenna mounted vertically with respect to the ground. In FIG. 8, the location of the terminals of the feed 68A on the bottom connector 30 and on the truck roof 60, as was described with reference to FIG. 7, produces a current distribution, shown by arrows n FIG. 8, wherein current flows simultaneously through all of the radiating elements 24, and via the transceiver 66 into the outer electrically conductive skin of the body of the truck 22, and then via the post 70 to the ground. The current path is then completed by way of displacement current of the electromagnetic wave, the displacement current flowing between ground and the radiating elements in the manner suggester by the electric field portrayed in FIG. 3. Thus, with the current distribution portrayed in FIG. 8, the truck body which serves as a supporting base for the antenna 20 also acts as a part of the antenna 20 to provide for a current distribution wherein a radiating electromagnetic field emanates from both the radiating elements 24 and the body of the truck 22.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. An antenna comprising:

a plurality of radiating elements arranged about a central longitudinal axis of the antenna, each of said elements being configured as an elongated arm of electrically conductive material positioned away from said axis, the radiating elements being spaced apart from each other;

a first connector and a second connector located spaced apart from each other and on said axis;

wherein each of said radiating elements has a first end fixed to said first connector and a second end fixed to second connector, said first and second connectors supporting said radiating elements in an array about said axis, said first connector electrically connecting together the first ends of said radiating elements, said second connector electrically connecting together the second ends of said radiating elements;

said antenna further comprises a feed having a first terminal connected to said first connector and a second terminal connected to ground;

wherein each of said radiating elements comprises a first section, a second section and an impedance element joining said first section to said second section;

a central positioning unit located midway between said first connector and said second connector, said central positioning unit extending radially outward from said axis to engage with said radiating elements;

a mast disposed along said axis for supporting said first connector, said second connector and said central positioning unit in their respective locations, said mast and said positioning unit being electrically insulated from said radiating elements; and an electrically conductive support secured to san end of said mast;

wherein said support comprises a vehicle having a floor and a roof, said roof having an aperture for passage of said mast, said mast passing through said aperture without making electrical contact with said roof, said mast connecting with said floor.

2. An antenna according to claim 1 wherein said mast comprises an electrically conductive support disposed on the axis to serve as a parasitic radiator of said antenna.

3. An antenna according to claim 1 wherein said first section of each radiator is connected to said first connector and said second section is connected to said second connector, said first section being shorter than said second section.

4. An antenna according to claim 1 wherein said impedance element comprises a resistor serially connected between said first section and said second section in each of said radiating elements.

5. An antenna according to claim 1 wherein said impedance element comprises a resistor and an inductor connected in parallel, said impedance element being serially connected between said first section and said second section in each of said radiating elements.

6. An antenna according to claim 1 wherein said impedance element comprises a resistor, an inductor and a capacitor all connected in parallel, said impedance element being serially connected between said first section and said second section in each of said radiating elements.

7. An antenna according to claim 1 wherein each of said radiating elements is configured as a wire, the wires of said radiating elements being positioned symmetrically about said mast.

8. An antenna according to claim 1 wherein said mast being fixed to said floor but electrically insulated form said floor, said support being electrically coupled to ground and to one feed terminal of said antenna, the other feed terminal of the antenna being electrically coupled to said radiating elements, whereby said vehicle comprises part of the radiating elements of said antenna.

9. An antenna according to claim 1 wherein said support is electrically coupled to ground and to one feed terminal of said antenna, the other feed terminal of the antenna being electrically coupled to said radiating elements, whereby said support comprises part of the radiating elements of said antenna.

* * * * *